US009004371B2

(12) United States Patent
Robinson et al.

(10) Patent No.: US 9,004,371 B2
(45) Date of Patent: Apr. 14, 2015

(54) SYSTEMS AND RELATED METHODS INVOLVING ISOLATION TUBS

(75) Inventors: Glenn Robinson, Camden, AL (US); William H. Moorhead, Smithfield, VA (US)

(73) Assignee: PCI-Trammco, LLC., Camden, AL (US)

( * ) Notice: Subject to any disclaimer, the term of this patent is extended or adjusted under 35 U.S.C. 154(b) by 399 days.

(21) Appl. No.: 13/277,318

(22) Filed: Oct. 20, 2011

(65) Prior Publication Data

US 2012/0286055 A1 Nov. 15, 2012

Related U.S. Application Data

(60) Provisional application No. 61/485,327, filed on May 12, 2011.

(51) Int. Cl.
*E01B 21/00* (2006.01)
*E01C 9/06* (2006.01)

(52) U.S. Cl.
CPC .. *E01C 9/06* (2013.01); *E01B 21/00* (2013.01)

(58) Field of Classification Search
CPC ..... B61B 13/00; B61B 15/00; E01B 2/00; E01B 2/006; E01B 25/00
USPC ..... 104/53, 58, 59, 69, 70, 72, 73, 104/124–126; 238/2–6
See application file for complete search history.

(56) References Cited

U.S. PATENT DOCUMENTS 4,063,517 A * 12/1977 Nardozzi, Jr. ..... 104/35

* cited by examiner

*Primary Examiner* — R. J. McCarry, Jr.
(74) *Attorney, Agent, or Firm* — McClure, Qualey & Rodack, LLP

(57) ABSTRACT

Systems and related methods involving isolation tubs are provided. In this regard, a representative system includes: an isolation tub formed of fiberglass reinforced plastic resin, the tub defining a reservoir; concrete positioned within the reservoir; and rails extending across the tub and being supported by the concrete, the rails being spaced from each other to form a special trackwork (STW) assembly.

16 Claims, 7 Drawing Sheets

SYSTEMS AND RELATED METHODS INVOLVING ISOLATION TUBS

CROSS-REFERENCE TO RELATED APPLICATION

This utility application claims priority to U.S. Provisional Application 61/485,327, which was filed on May 12, 2011, and which is incorporated by reference herein in its entirety.

TECHNICAL FIELD

The present disclosure generally relates to embedded track systems, such as those for streetcars.

DESCRIPTION OF THE RELATED ART

In current projects to construct embedded track systems for light rail vehicles (LRV's) and streetcar operations, the switches and crossings (known as "special trackwork" (STW) assemblies) are usually housed in a reinforced concrete outer structural basin with a lining of composite plastic sheeting to provide electrical isolation. The plastic lining is overlapped and heat-sealed all around to be water and electrically tight. Occasionally, a lining of polyurea spray-on coating has been used in place of plastic sheeting.

After the lining is complete, metal components of the STW assemblies are assembled inside the lined tub while taking care to avoid punching holes in the lining. The desire to prevent the formation of holes is apparent in that many specifications call for the use of a layer of asphaltic protection board. Portland cement concrete is placed, usually in a 2-pour sequence, to lock the STW assembly in place, and also to provide a pavement surface for vehicular and pedestrian traffic.

In both cases noted above, electrical isolation often does not meet the specifications for track-to-earth resistivity because of holidays in the lining. Additionally, both methods are labor-intensive and require special skills and equipment to install. The overall installation costs are also quite high, as a number of complicated steps are typically required—a fairly deep excavation, formwork and rebar to construct the basin, the considerable expense of the material and labor to install the isolation lining—plus the cost of installing and cementing in the STW assembly itself.

SUMMARY

Systems and related methods involving isolation tubs are provided. In this regard, an exemplary embodiment of a system comprises: an isolation tub formed of fiberglass reinforced plastic resin, the tub defining a reservoir; concrete positioned within the reservoir; and rails extending across the tub and being supported by the concrete, the rails being spaced from each other to form a special trackwork (STW) assembly.

Another exemplary embodiment of a system comprises: a preformed center section having a perimeter edge; a preformed first side section having a perimeter edge; a preformed second side section having a perimeter edge; a preformed end section having a perimeter edge; first and second rail channels; and a cap strip defining a top surface and having a channel facing away from the top surface; the center section, the first side section and the second side section being arranged such that the center section is positioned between the first side section and the second side section and bonded therebetween; the center section, the first side section, the second side section and the end section being bonded together to form a portion of an integrated tub defining a reservoir; corresponding portions of the respective perimeters of the center section, the first side section, the second side section and the end section defining an upper edge; the first and second rail channels extending across the upper edge from the reservoir to an exterior of the integrated tub; the cap strip extending along and being bonded to the upper edge such that the upper edge is received within the channel of the cap strip.

An exemplary embodiment of a method for forming special trackwork comprises: arranging preformed fiberglass reinforced plastic resin sections at a location for a special trackwork; sealing joints between the sections to form an integrated tub; and installing rail channels, each of which is sized and shaped to receive a rail, at locations along an upper edge of the integrated tub.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Systems and related methods involving isolation tubs are provided, several exemplary embodiments of which will be described in detail. In this regard, a representative embodiment of a system involves the use of an integrated tub formed of multiple, readily-transportable sections that can be assembled on site. Notably, the sections can be arranged in various configurations to provide tubs of different sizes and shapes. The sections are sealed together to form a watertight, electrical isolation barrier within which numerous track components can be mounted. As such, a representative integrated tub serves as a complete formwork for concrete that is placed inside the integrated tub to support special trackwork (STW) assemblies and remains in place to serve as a paving surface.

Figure 1:
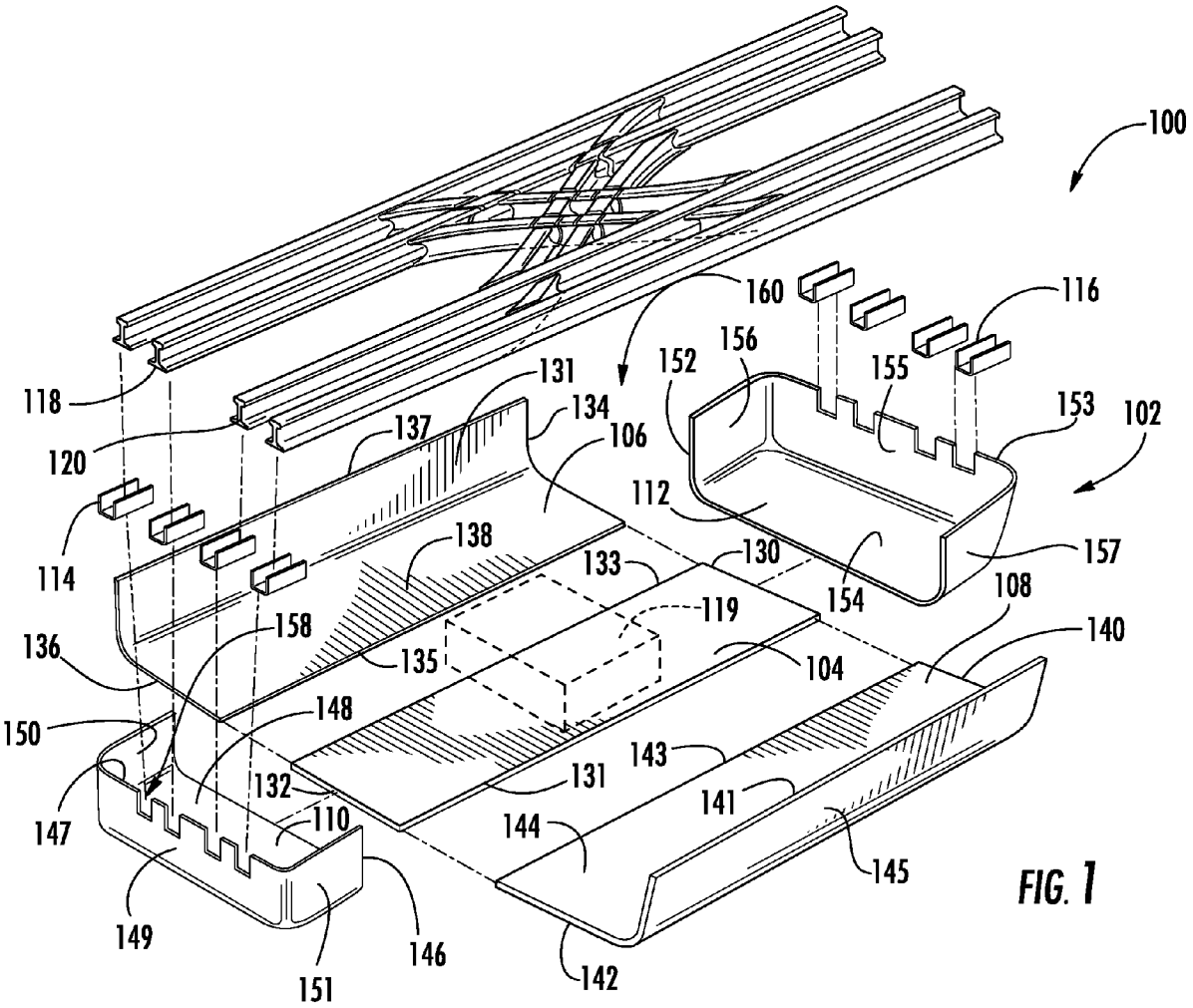
FIG. 1 is a schematic diagram depicting an exploded view of an exemplary embodiment of a system.

With continued reference to the drawings, FIG. 1 is a schematic diagram depicting an exploded view of an exemplary embodiment of a system. As shown in FIG. 1, system 100 includes an integrated tub 102 that is formed of multiple preformed sections. Although capable of being formed in various configurations of sections that are joined to define a reservoir, such as those that include bases and sidewalls extending upwardly from the bases, a particular non-limiting configuration is shown. Specifically, the embodiment of FIG. 1 incorporates a center section 104, opposing side sections 106, 108 and opposing end sections 110, 112. Note that the end sections are a variation of section that includes a portion of a sidewall, with the distinction being that the associated rail crosses from the interior to the exterior of the tub along a portion of the end section. In contrast, a side section does not have such a rail crossing.

Rail channels (e.g., channels 114, 116) and rails (e.g., rails 118, 120) of the system also are depicted. Notably, the portions of the rails shown in dashed lines are portions that interact directly with other components, such as switch throw mechanism 119. Note also that various details that are beyond the scope of this discussion are not depicted.

The tub sections are preferably factory-made in large dimensions proportioned for shipping and handling purposes, and are assembled in the field. For instance, the sections can be sized to permit truck shipment in a nested fashion for economy and can be shipped with lifting lugs already fitted to allow for ease of jobsite handling. In some embodiments, the sections are formed of fiberglass-reinforced plastic resin. For instance, fiberglass reinforced (hand-laid fabrics for laminate schedule) plastic resin of a styrene-diluted unsaturated polyester-based reactive resin compound can be used. As such, the sections exhibit properties such as electrical resistivity, hardness, resistance to aging, and tensile and compressive strength. These properties tend to assure a long, successful service life. It should be noted that other compounds may be used in other embodiments.

In the embodiment of FIG. 1, center section 104 is elongate in shape and defines a rectangular perimeter with edges 130, 131, 132 and 133. It should be noted that the scale of FIG. 1 is not necessarily true as the center section may be approximately 10 s of feet in width while being over 100 feet in length, with the practical limit being established primarily by manufacturing and shipping considerations.

Side section 106 is elongate in shape and defines a perimeter with edges 134, 135, 136 and 137. Side section 106 also incorporates a bottom wall 138 and a side wall 139. Side section 108 is a duplicate of side section 106 and includes edges 140, 141, 142 and 143, as well as a bottom wall 144 and side wall 145. End section 110 includes edges 146 and 147 and incorporates a bottom wall 148, an end wall 149 and side walls 150, 151. End section 112 is a duplicate of end section 110 and includes edges 152, 153, and walls 154, 155, 156 and 157.

When assembled, edges 133 and 135, and edges 131 and 143 are bonded together. Additionally, edge 152 is bonded to edges 134, 130 and 140, and edge 146 is bonded to edges 136, 132 and 142. As such, an integrated tub is formed that defines a reservoir 160. It should be noted that various configurations other than that depicted in FIG. 1 can be provided.

In FIG. 1, the end sections include locations for receiving rail channels, which serve as placement guides for the rails. By way of example, end section 110 includes a cut-out 158 that is configured to receive rail channel 114. In the depicted embodiment, the rail channels are configured as lengths of C-channel with opposing rectangular side walls and intermediate rectangular bases. When assembled with the integrated tub, the rail channels are oriented with open ends facing upwardly.

Also shown schematically in FIG. 1 (in dashed lines) is a representative switch throw mechanism 119. Such a mechanism is placed within the reservoir defined by the tub and is operative to position rails and/or associated components as is known.

Figure 2:
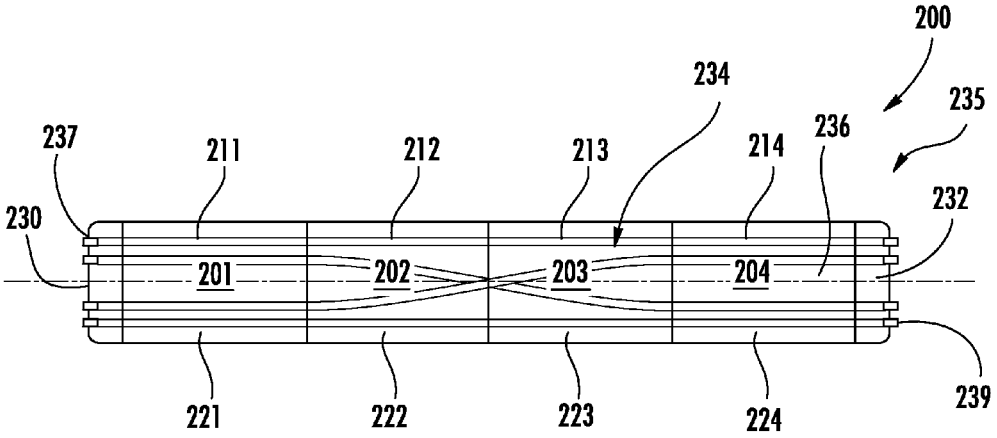
FIGS. 2 and 3 are schematic diagrams depicting plan views of other exemplary embodiments.
Figure 3:
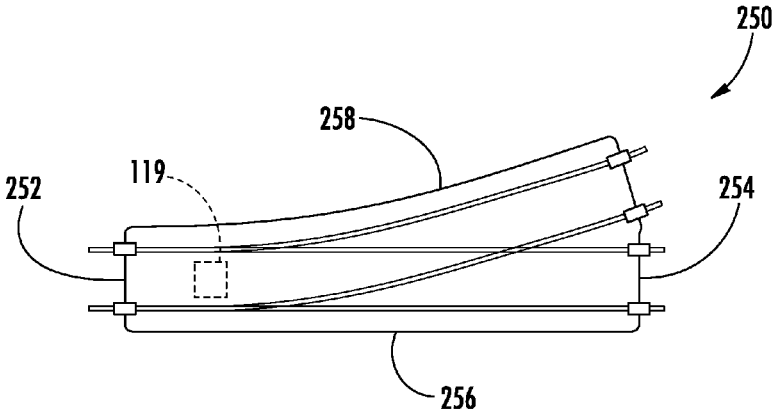

FIGS. 2 and 3 are schematic diagrams depicting plan views of other exemplary embodiments. In particular, system 200 of FIG. 2 includes multiple sections. For instance, system 200 includes first through fourth center sections (201, 202, 203 and 204), first through fourth left side sections (211, 212, 213 and 214), first through fourth right side sections (221, 222, 223 and 224), and opposing end sections (230 and 232). Various other numbers of sections can be used in other embodiments.

When assembled, like ones of the sections are oriented in end-to-end relationships. By way of example, the first through fourth center sections are arranged in sequence such that section 202 is positioned between sections 201 and 203. Similarly, the first through fourth left side sections are arranged in sequence such that section 212 is positioned between sections 211 and 213. Additionally, like numbered sections are oriented in side-by-side relationships. For instance, first center section 201 is positioned between first left side section 211 and first right side section 221. Further, end section 230 spans the ends of the first sections, while end section 232 spans the opposing ends of the fourth sections to define a reservoir 234.

The sections are bonded together, such as with a plastic resin of a styrene-diluted unsaturated polyester-based reactive resin compound, to form an integrated tub 235 that is generally rectangular in shape when viewed in plan. Thus, tub 235 exhibits symmetry along a longitudinal axis 236.

Additionally, rail channels are included that are attached to the end sections of the tub. For example, end section 230 includes a rail channel 237, and end section 232 includes a rail channel 239.

FIG. 3 depicts an embodiment of a system 250 that does not exhibit longitudinal symmetry. Specifically, the lack of symmetry is attributable, at least in part, to ends 252, 254 of the system exhibiting different widths. Notably, end 254 is wider than end 252. Additionally, although side 256 of the system is generally linear, side 258 exhibits a deflection such that the sides diverge from each other along the length of the system from end 252 to end 254.

Figure 4:
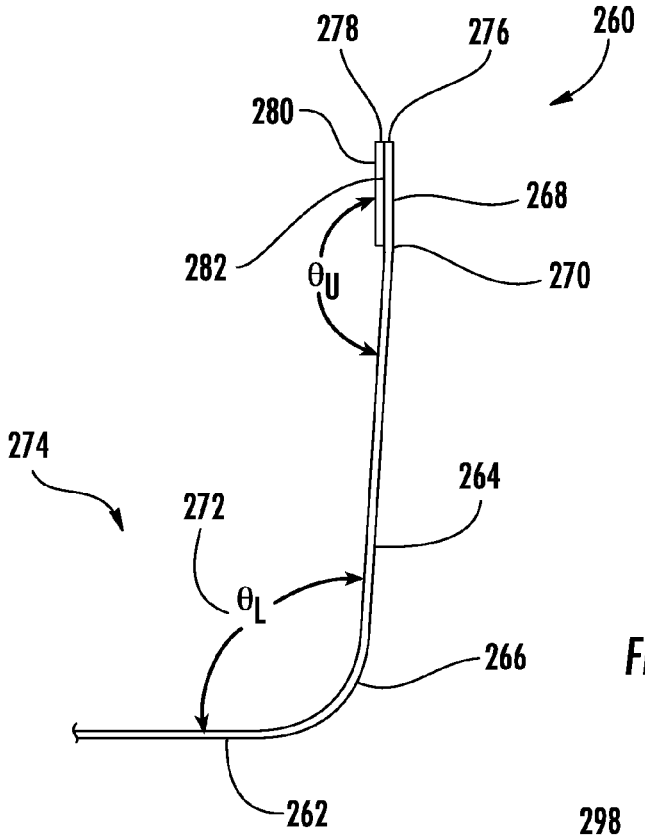
FIG. 4 is cut-away, cross-sectional view of an exemplary embodiment of a preformed side section.

FIG. 4 is cut-away, cross-sectional view of an exemplary embodiment of a preformed side section. As shown in FIG. 4, section 260 includes a bottom portion 262, a lower side portion 264, a lower edge 266, an upper side portion 268 and an upper edge 270. The lower edge is positioned between the bottom portion and the lower side portion. The lower edge exhibits a radius of curvature, with the center 272 of the radius being located within the reservoir 274 of the tub in this embodiment.

The lower side portion and the bottom portion define an included angle ($\theta_L$), which is between approximately 93° and approximately 95°. Preferably, angle ($\theta_L$) is greater than 90 degrees.

The upper edge is positioned between the lower side portion and the upper side portion. The lower side portion and the upper side portion define an included angle ($\theta_U$), which is between approximately 175° and approximately 177°. Preferably, angle ($\theta_U$) is less than 180 degrees.

An uppermost edge 276 of the upper side portion forms a portion of the upper peripheral edge 278 of the tub. Additionally, a trim section 280 is attached to the inner surface 282 of the upper side portion to form a thickened portion of the tub that reinforces the upper peripheral edge. In this embodiment, the trim section is formed of fiberglass reinforced plastic resin that is bonded to the upper side portion.

Figure 5:
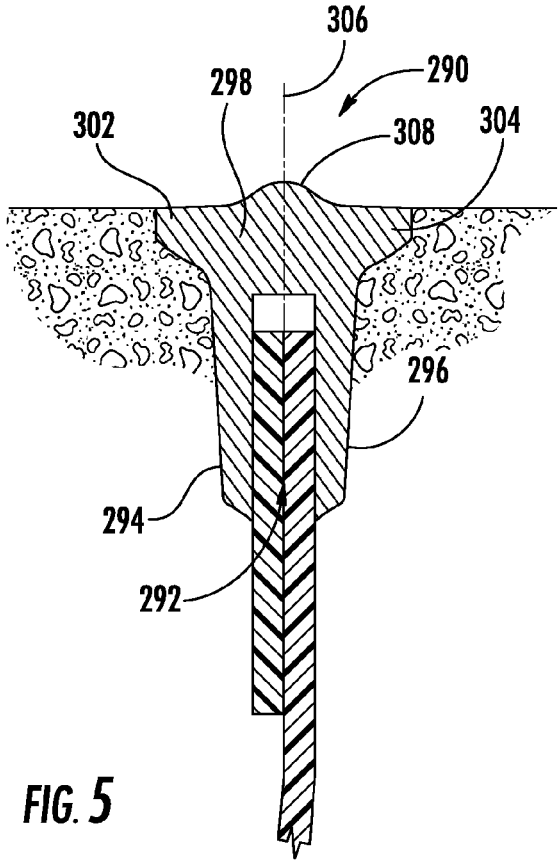
FIG. 5 is cut-away, cross-sectional view of the side section of FIG. 4, showing detail of the upper side portion and an associated cap strip.

FIG. 5 is cut-away, cross-sectional view of the embodiment of FIG. 4, showing detail of the upper side portion and an associated cap strip. As shown in FIG. 5, cap strip 290 includes a downward facing, edge-receiving channel 292 that is defined by channel walls 294, 296. In this embodiment, the channel walls extend from a body 298, with outer surfaces of the channel walls being tapered toward the distal ends. Side flanges 302, 304 extend laterally outwardly from the body, with top surfaces of the flanges converging toward a centerline 306 of the cap strip to form a protruding ridge 308. Ridge 308 is generally rounded as viewed in cross-section. Also shown in FIG. 5 is a representation of a profile grade line that shows the position of the cap strip after installation.

Figure 6:
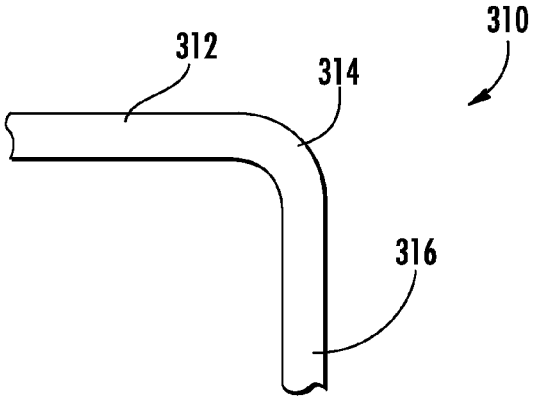
FIG. 6 is cut-away, plan view of an exemplary embodiment of a cap strip.

FIG. 6 is cut-away, plan view of an exemplary embodiment of a cap strip. In FIG. 6, cap strip 310 is formed of multiple sections of cap strip that are positioned end-to-end. Specifically, sections 312, 314 and 316 are depicted, with sections 312 and 316 being generally linear and section 314 being curved.

Figure 7A:
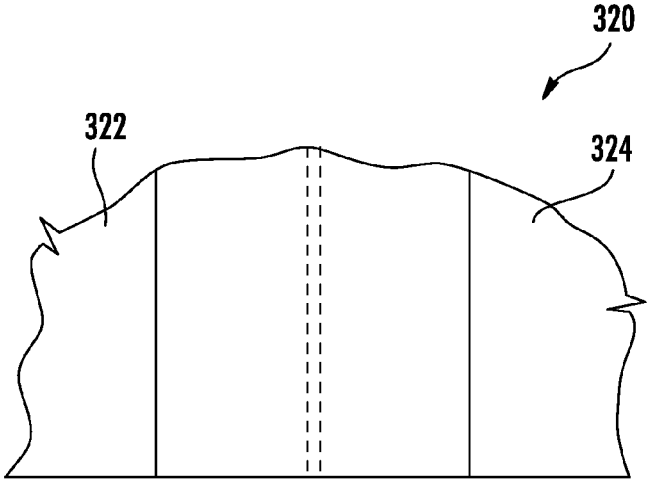
FIGS. 7A and 7B are cut-away plan and end views, respectively, showing an exemplary embodiment of a section joint.
Figure 7B:
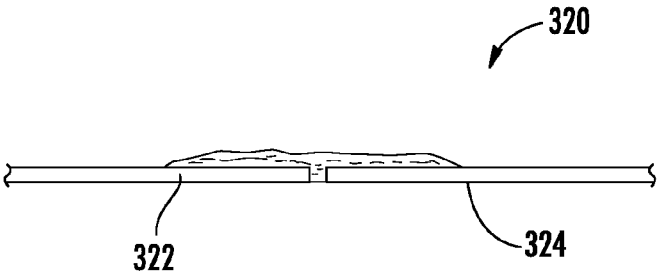

FIGS. 7A and 7B are cut-away plan and end views, respectively, showing an exemplary embodiment of a section joint. Specifically, joint 320 is depicted as attaching two adjacent sections 322, 324. The joint forms a structural and watertight seal between the sections. Notably, the adjacent sections may be spaced from each other (such as by a gap of up to approximately ¼ inches). In this embodiment, the joint is approximately 3 inches in width and 3/16 inches in thickness although various other dimensions could be used. The joint is formed by cleaning the surfaces thoroughly with acetone or MEK solvent, applying fiberglass mat cut to size 3" wide by the appropriate length of the joint, and applying a styrene-diluted unsaturated polyester-based reactive resin binder to form a strong, water- and electrically tight joint.

Figure 8:
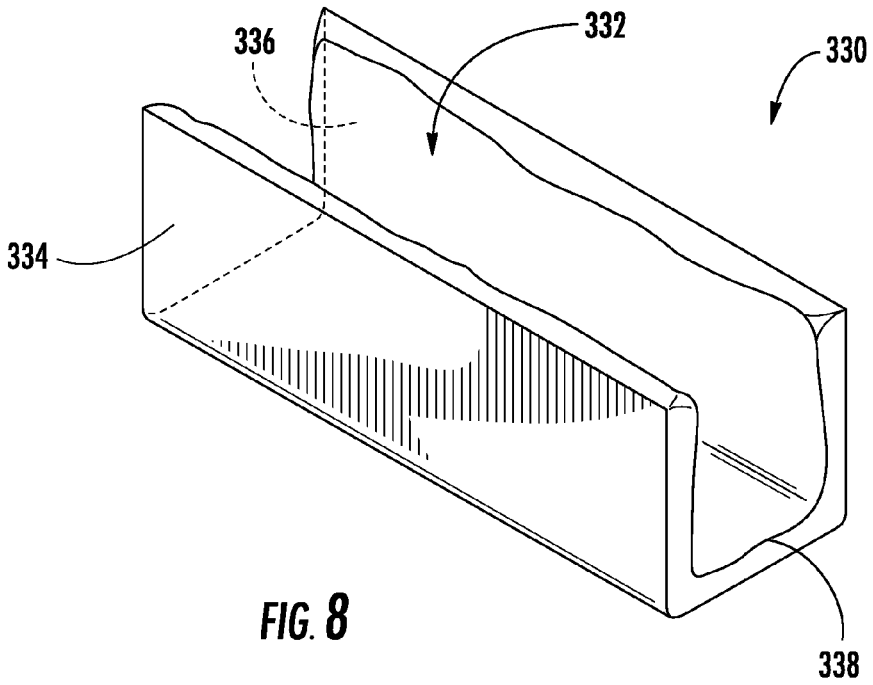
FIG. 8 is a schematic diagram depicting an exemplary embodiment of a rail channel.

FIG. 8 is a schematic diagram depicting an exemplary embodiment of a rail channel. As shown in FIG. 8 rail channel 330 is configured as an elongate length of C-channel formed of fiberglass reinforced plastic resin. The channel 332 of the rail channel is upwardly facing when assembled, so that exterior surfaces 334 of the rail channel assist in shaping the concrete fill of the tub for supporting the rails.

Interior surfaces 336 of the rail channel are positioned to receive a lining 338 of an electrically insulative material (e.g., an elastomeric infill material). Notably, a corresponding rail extends within the channel and is electrically isolated therein due to the insulative material.

Figure 9:
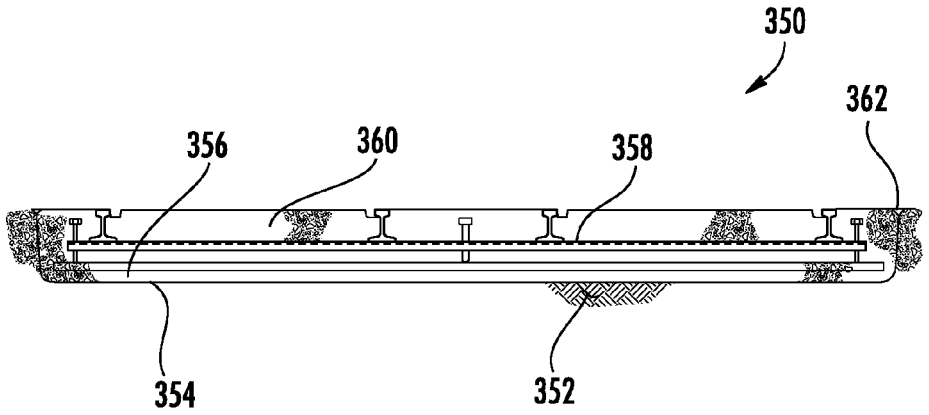
FIG. 9 is a cut-away end view of an exemplary embodiment of a system.

FIG. 9 is a cut-away end view of another exemplary embodiment of a system. As shown in FIG. 9, system 350 incorporates a compacted select subgrade 352 upon which an integrated tub 354 is positioned. Concrete (e.g., Portland cement concrete) forms a lower layer 356 within the tub that may be provided with a rake finish. In some embodiments, the lower layer is between approximately 5-6 inches in thickness. STW support beams and/or plates 358 are positioned above the lower layer and an upper layer of concrete 360 is added. Note that the cap strip 362 of the tub is located at the profile grade level after the installation is completed.

Figure 10:
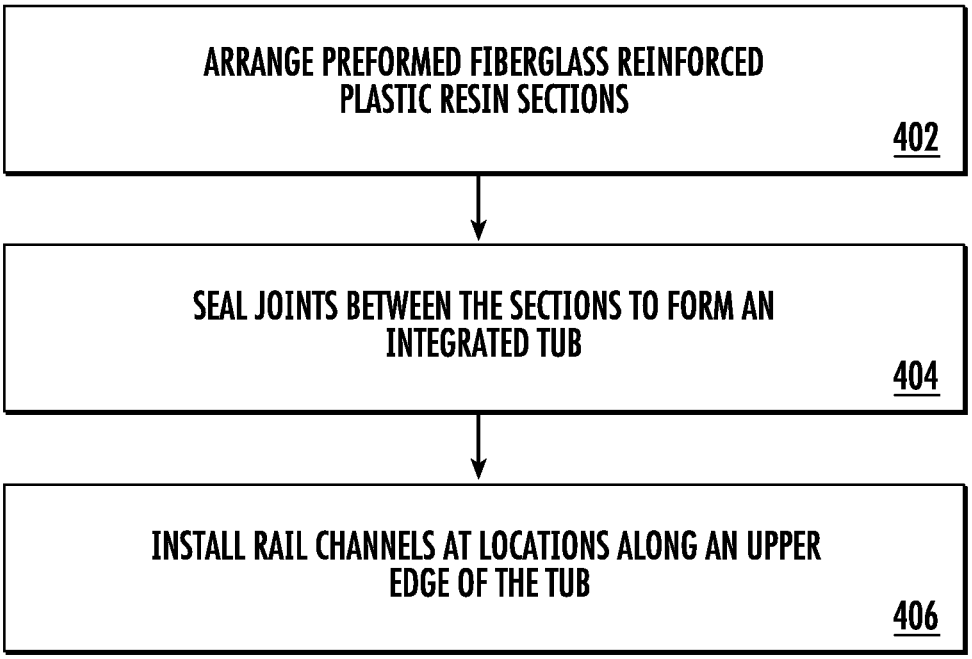
FIGS. 10 and 11 are flowcharts depicting exemplary embodiments of methods for forming special trackwork assemblies.
Figure 11:
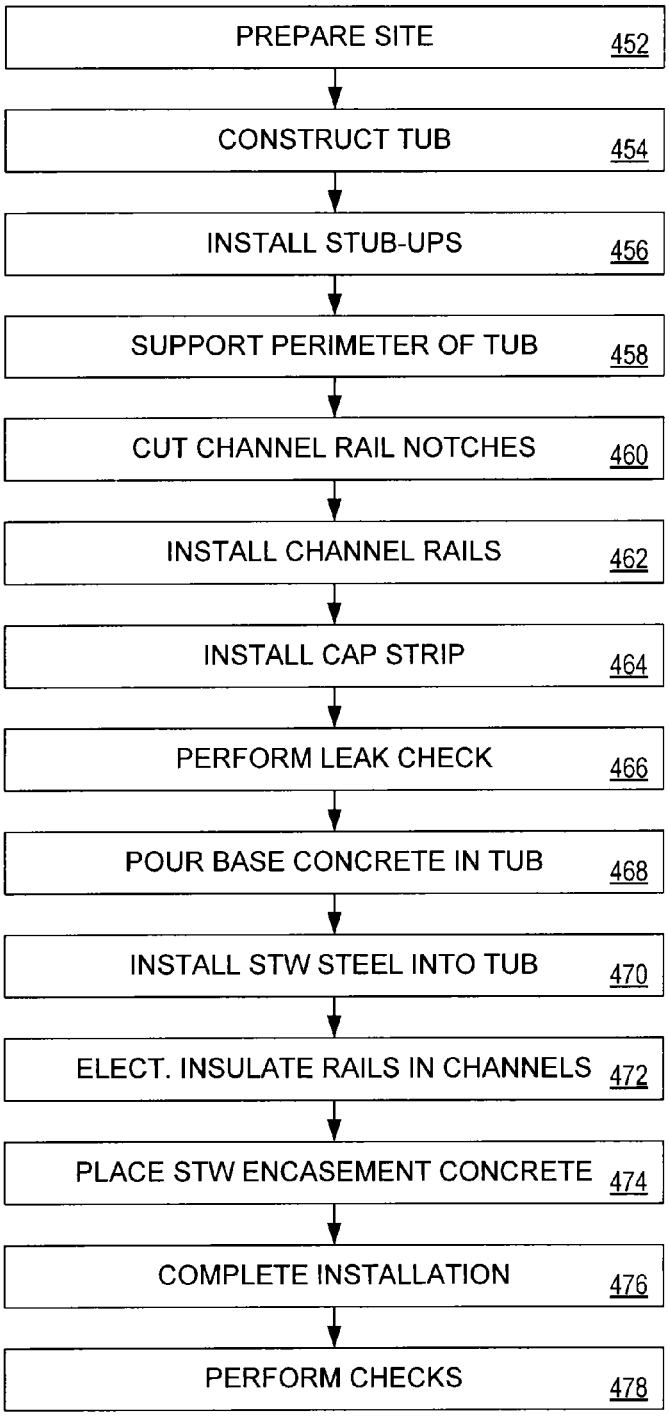

FIGS. 10 and 11 are flowcharts depicting exemplary embodiments of methods for forming special trackwork assemblies. It should be noted that the order of steps presented will suit most site conditions; however, special circumstances may require alteration of the order of the steps, but any such alterations will probably be minor.

As shown in FIG. 10, a representative method includes the step of arranging preformed fiberglass reinforced plastic resin sections at a location for forming a special trackwork assembly (block 402). In block 404, joints between the sections are sealed to form an integrated tub. Thereafter, such as depicted in block 406, rail channels are installed at locations along an upper edge of the integrated tub. Notably, each of the rail channels is sized and shaped to receive a rail. For instance, in some embodiments, each of the rail channels is a length of C-channel installed with respective open sides facing upwardly.

As shown in FIG. 11, another representative method includes preparing the site (block 452). For instance, demolition and excavation may be required, after which, a compacted, select fine-graded material bed such as OGS is provided. The bed can be approximately 5 to 6 inches thick with a 1 inch sand bed on top held to grade within ±¼", with appropriate underdrains per civil design. In block 454, a fiberglass tub is constructed using pre-molded sections (such as previously described). Notably, joints can be sealed with field-applied fiberglass overlays to form waterproof joints. Then, in block 456, stub-ups are installed and penetrations to the tub are sealed. Preferably, all such penetrations involve fiberglass conduit or similar materials, and field-applied fiberglass cuffs or other appropriate shapes are used for forming the seals.

In block 458, the perimeter of the tub is supported, such as by installing perimeter lumber backing or steel kickers around the sides of the tub to resist bulging during placement of concrete. Alternatively, the outside perimeter can first be partially filled with lean concrete or hot-mix asphalt (HMA) or compacted gravel to provide the desired support. Then, in block 460, notches (e.g., notches 8 inches wide by 8.50 inches in depth) are cut in locations of the tub where rails will cross the perimeter. Alternatively, the notches can be pre-formed into the sections. Regardless of the manner of formation, the notches are preferably centered on the rail CL and in alignment.

In block 462, rail channels are installed at the notches. In some embodiments, the rail channels are 8.00 inches wide× 8.50 inches deep×24 inches in length. Additionally, any upstanding, isolating dividers required for rail/signal/Traction Power (TP) return can be installed.

Then, in block 464 cap strip is installed. This can be accomplished by trimming the top edge of tub to within approximately ¼" of correct grade and then placing the cap strip along the upper perimeter edge of the tub to the exact grade line.

In block 466, a leak check is performed such as by filling the tub with water and also spark checking for holidays with a megger tester. Any leaking areas can be repaired, after removing the water, such as with fiberglass resin overlay. Water is re-introduced and the tub is retested. When electrical and leakage testing is completed successfully, the water is then removed from the tub. Then, in block 468, a concrete "mud" base is poured. In some embodiments, the base is approximately 5-inches thick and includes mesh reinforcement. Notably, the mesh can be made electrically common with TP return with an optional interruptible connection.

In block 470, STW steel is installed in the tub. By way of example, supports such as steel or plastic ties on adjustable screw legs, or some other support, such as DF pads using locating jigs can be used to adjust geometry to the correct profile. If required, concrete reinforcement can be placed that can be made electrically common with the mesh and the TP return with an interruptible connection. In block 472, the rails are electrically insulated such as by using Icosit™ or a similar polyurethane electrically-isolating elastomeric material around the rails in the rail channels. Notably, a spark test can be performed to ensure electrical isolation.

In block 474, STW encasement concrete is placed (e.g., in a 1- or 2-pour method), finished and cured. Then, in block 476, the installation is completed, such as by cleaning up laitance, flangeways, overspill on STW, etc., installing components such as switch machines, and completing electrical hookups. Thereafter, such as depicted in block 478, final checks are performed, such as track-to-earth resistance tests, systems tests, and track/STW operational tests. It should be noted that various items such as sump pumps, drain catch basins, etc. are not covered by the procedure noted above, but may be required as is known.

There may be various reasons for and/or benefits derived from using a system such as described above over that of a conventional PVC/Elvaloy flexible membrane or spray-on coating such as polyurea. Such reasons and/or benefits may include one or more of the following: an integrated tub is strong and may not require the overlay of protection board to prevent damage and punctures; preform section rigidity allows easy installation on vertical surfaces, and the construction of separator dams in the gauge of the track to isolate the signal rail from the TP return rail, or to separate signal circuits; the use of a chopped glass/polyester resin mix for making the splice joints between the panel boards allows fast and easy sealing in 3-way corners and around blockouts as well as flat surfaces with normal construction skills, and the volume resistivity of the joint material is slightly higher than the factory-made board (see CIEMS Test Report #1060411172); sections can be furnished in large sheets (probably 8-ft×30-ft or more) to minimize joints, and in custom shapes where required, and can be bent to fit large-radius curved surfaces; electrically tight joining of the sections is much easier, faster and surer than the heat-sealing of the PVC/Elvaloy membrane, especially in 3-way corners; the sections can be joined to other materials (such as Icosit™) or with concrete and other construction materials using adhesives versus PVC/Elvaloy that is virtually impossible to bond to other materials with an electrically-tight joint; the sections are not prone to small punctures during installation and subsequent track construction, a problem with both flexible membrane and spray-on coatings; no extended cure time of a concrete tub is required prior to installing an integrated tub, as is required by the spray-on coatings; the integrated tub is ready for further construction steps immediately after joints are made; there is no over-spray problem; by eliminating the outside reinforced concrete "bathtub" substantial cost & time savings can be realized; all tasks required to install the system properly are within worker skill sets and equipment commonly found on these types of construction sites.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure.

The invention claimed is:

1. A system for forming a special trackwork assembly for a rail vehicle supported by first and second laterally spaced rails, the system comprising:

a preformed center section having a perimeter edge;

a preformed first side section having a perimeter edge;

a preformed second side section having a perimeter edge;

a preformed end section having a perimeter edge;

first and second rail channels spaced from each other, wherein the rail channels are each configured as an elongate length of C-channel to receive the first and second laterally spaced rails, respectively, and wherein an interior surface of each of the rail channels comprises a lining of electrically insulative material; and a cap strip defining a top surface and having a channel facing away from the top surface;

the center section, the first side section and the second side section being arranged such that the center section is positioned between the first side section and the second side section and bonded therebetween;

the center section, the first side section, the second side section and the end section being bonded together to form a portion of an integrated tub defining a reservoir;

corresponding portions of the respective perimeters of the center section, the first side section, the second side section and the end section defining an upper edge;

the first and second rail channels extending across the upper edge from the reservoir to an exterior of the integrated tub such that the first and second rails are positioned adjacent the upper edge to engage wheels of the track vehicle;

the cap strip extending along and being bonded to the upper edge such that the upper edge is received within the channel of the cap strip.

2. The system of claim 1, wherein the center, first side, second side and end sections are fiberglass reinforced plastic resin sections.

3. The system of claim 1, wherein the cap strip is elongate and has opposing lengthwise flanges, with upper surfaces of the flanges forming the top surface.

4. The system of claim 1, further comprising waterproof joints between the sections such that the integrated tub is watertight.

5. A system comprising:

an isolation tub formed of fiberglass reinforced plastic resin, the tub defining a reservoir;

concrete positioned within the reservoir;

rails extending across the tub along an upper edge thereof and being supported by the concrete, the rails being spaced from each other to form a special trackwork (STW) assembly with the first and second rails being positioned to engage wheels of a track vehicle operating on the STW; and rail channels each configured as an elongate length of C-channel and positioned to receive the rails, wherein an interior surface of each of the rail channels comprises a lining of electrically insulative material.

6. The system of claim 5, wherein:

the tub has an upper peripheral edge; and the system further comprises an elongate cap strip with a lengthwise channel, the cap strip being positioned such that the upper peripheral edge is received within the channel.

7. The system of claim 5, wherein:

the isolation tub comprises multiple sections, each of the sections being formed of layers of fiberglass fabric and having an inside surface for defining a respective portion of the reservoir and an outside surface for defining a respective portion of an exterior of the tub; and the multiple sections being bonded together with a plastic resin of a styrene-diluted unsaturated polyester-based reactive resin compound.

8. The system of claim 7, wherein each respective portion of the reservoir defined by a section comprises an individual reservoir such that the reservoir comprises multiple reservoirs bonded together.

9. The system of claim 5, wherein:

the isolation tub comprises a side section configured as a length of fiberglass reinforced plastic resin;

the side section has a bottom portion, a lower side portion, a lower edge and an upper side portion;

the lower edge is positioned between the bottom portion and the lower side portion and exhibits a radius of curvature; and the lower side portion and the bottom portion define an included angle of greater than 90 degrees.

10. The system of claim 9, wherein:

an uppermost edge of the upper side wall forms a portion of the upper peripheral edge of the tub; and the system further comprises an elongate trim section of fiberglass reinforced plastic resin bonded to the upper side wall to form a thickened portion of the tub.

11. The system of claim 9, wherein the center of the radius of curvature is located within the reservoir of the tub.

12. A method for forming special trackwork assemblies comprising:

arranging preformed fiberglass reinforced plastic resin sections at a location for a special trackwork assembly for a track vehicle;

sealing joints between the sections to form an integrated tub;

installing rail channels laterally spaced from each other, each of which is sized and shaped to receive a rail, at locations along an upper edge of the integrated tub such that the rails are positioned adjacent the upper edge to engage laterally spaced wheels of the track vehicle; and positioning elastomeric infill material within interior surfaces of the rail channels.

13. The method of claim 12, wherein each of the rail channels is a length of C-channel installed with respective open sides facing upwardly.

14. The method of claim 12, wherein installing rail channels comprises:

cutting notches in the upper edge of the integrated tub; and inserting a respective one of the rail channels at each of the notches.

15. The method of claim 12, further comprising pouring concrete into the integrated tub.

16. The method of claim 15, further comprising:

supporting rails, positioned to extend within the rail channels, with the elastomeric infill material.

* * * * *